US007311073B1

(12) United States Patent
Kim et al.

(10) Patent No.: US 7,311,073 B1
(45) Date of Patent: Dec. 25, 2007

(54) CONTINUOUS VARIABLE VALVE LIFT APPARATUS

(75) Inventors: Dae Sung Kim, Hwaseong (KR); WooTae Kim, Hwaseong (KR); Back Sik Kim, Hwaseong (KR); Hyung Ick Kim, Gunpo (KR); In Gee Suh, Yongin (KR); Dong Hee Han, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/648,738

(22) Filed: Dec. 29, 2006

(30) Foreign Application Priority Data

Nov. 16, 2006 (KR) ..... 10-2006-0113490

(51) Int. Cl.
*F01L 1/18* (2006.01)

(52) U.S. Cl. ..... 123/90.41; 123/90.16; 123/90.39; 74/569

(58) Field of Classification Search ..... 123/90.16, 123/90.2, 90.27, 90.31, 90.39, 90.41, 90.44; 74/559, 567, 569
See application file for complete search history.

(56) References Cited

U.S. PATENT DOCUMENTS 6,955,146 B2 * 10/2005 Werler ..... 123/90.16
7,261,074 B2 * 8/2007 Kim et al. ..... 123/90.16

* cited by examiner

*Primary Examiner*—Ching Chang
(74) *Attorney, Agent, or Firm*—Morgan Lewis & Bockius LLP

(57) ABSTRACT

A continuous variable valve lift (CVVL) apparatus adjusting a valve lift, duration of valve opening and closing, and a valve timing includes a cam rotating by a cam shaft, a first shaft having a first radius, a second shaft having a second radius smaller than the first radius and coupled in the first shaft such that the first and second shafts are non-concentric, a roller moving upward and downward by a rotation of the cam and connected to the first shaft to be moved on the basis of a position of the first shaft, a first arm rotatably connected to the second shaft to be moved by the roller, and a second arm rotatably secured to a third shaft to open and close the valve by an operation of the first arm.

6 Claims, 9 Drawing Sheets

CONTINUOUS VARIABLE VALVE LIFT APPARATUS

CROSS-REFERENCE TO RELATED APPLICATION

This application claims priority to and the benefit of Korean Patent Application No. 10-2006-0113490 filed in the Korean Intellectual Property Office on Nov. 16, 2006, the entire contents of which are incorporated herein by reference.

BACKGROUND OF THE INVENTION (a) Field of the Invention

The present invention relates to a continuous variable valve lift apparatus.

(b) Description of the Related Art

Typically, a continuous variable valve lift apparatus can adjust valve lift or duration of the valve opening and closing, but not both. An apparatus than can adjust both is being developed; however, its scheme is complicated, efficiency is low, and manufacturing cost is high.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention provides a continuous variable valve lift apparatus with a simple scheme, high performance, and low manufacturing cost.

An exemplary embodiment of the present invention provides a continuous variable valve lift (CVVL) apparatus adjusting a valve lift, duration of valve opening and closing, and valve timing. The apparatus includes a cam rotating by a cam shaft, a first shaft having a first radius, a second shaft having a second radius smaller than the first radius and coupled in the first shaft such that the first and second shafts are non-concentric, a roller moving upward and downward by a rotation of the cam and connected to the first shaft to be moved on the basis of a position of the first shaft, a first arm rotatably connected to the second shaft to be moved by the roller, and a second arm rotatably connected to a third shaft to open and close the valve by an operation of the first arm.

The roller may be a double bearing.

The first arm becomes thin as it gets farther from the second shaft.

The first arm may include a protrusion, and an elastic member may be connected between the second shaft and the protrusion.

The continuous variable valve lift apparatus may further include a motor rotating the second shaft.

The motor may be a step motor.

DETAILED DESCRIPTION OF THE PREFERRED EMBODIMENTS

An exemplary embodiment of the present invention will hereinafter be described in detail with reference to the accompanying drawings.

Figure 1:
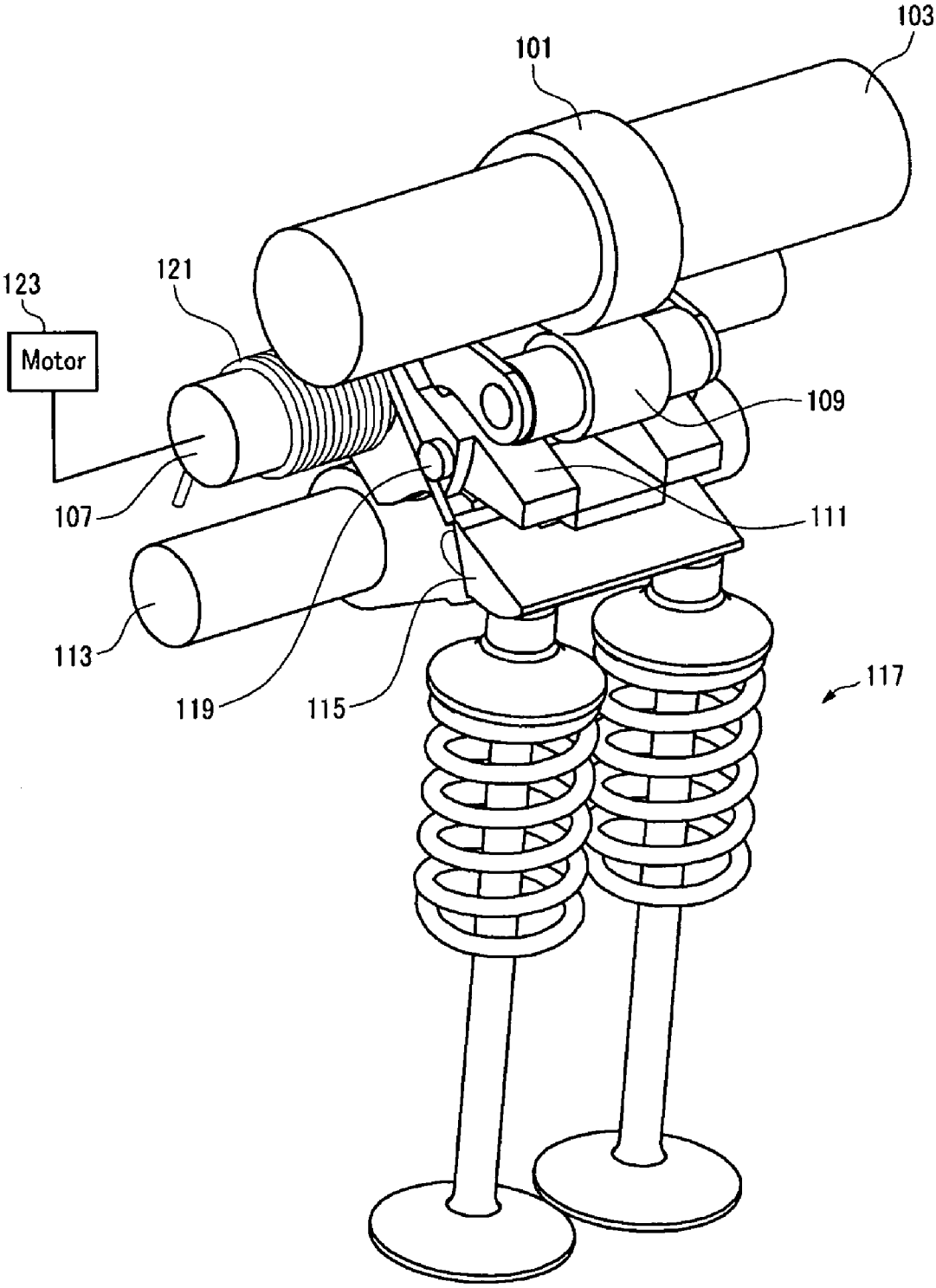
FIG. 1 is a perspective view showing a continuous variable valve lift apparatus according to an exemplary embodiment of the present invention.
Figure 2:
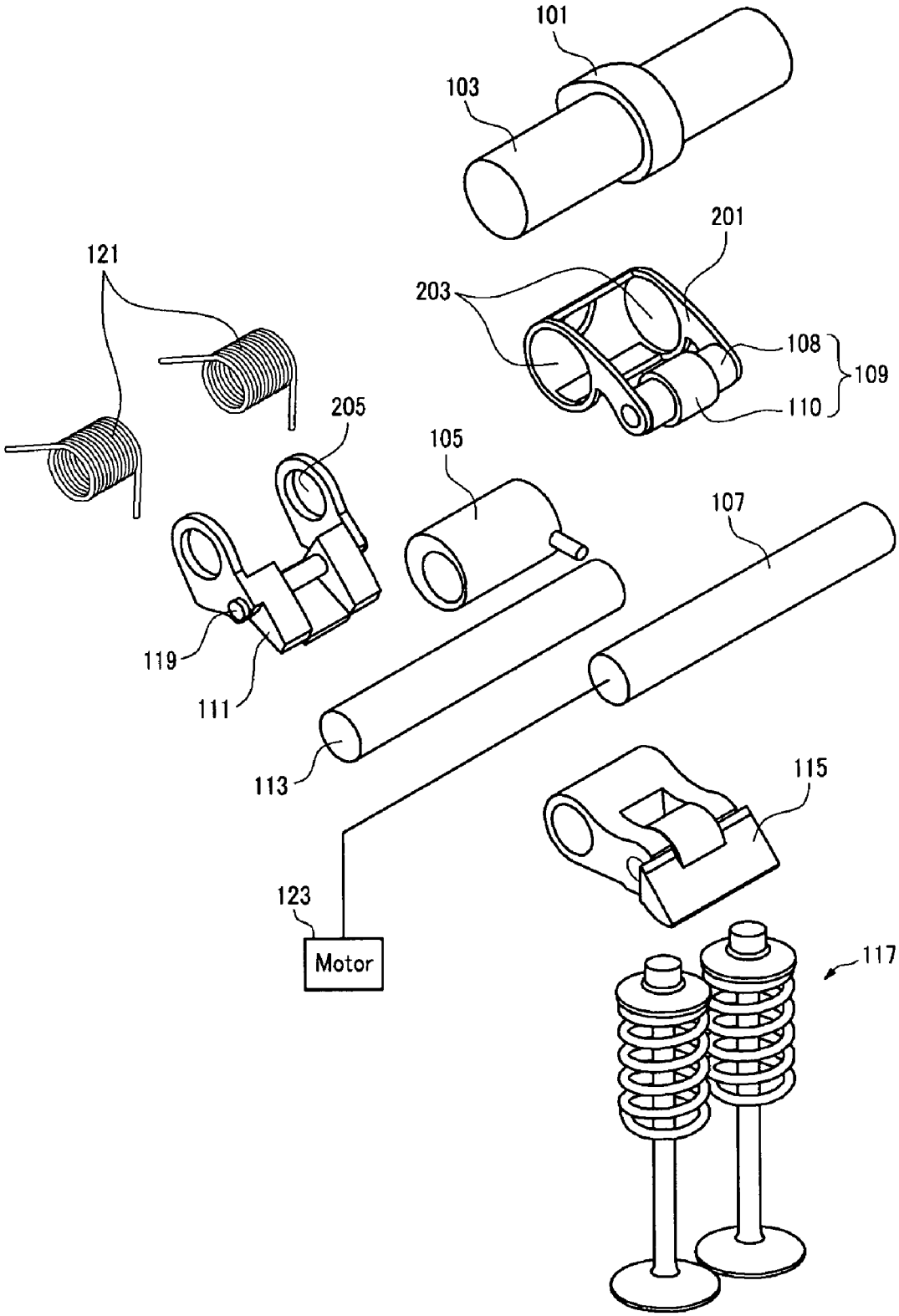
FIG. 2 is an exploded perspective view of the apparatus of FIG. 1.

As shown in FIG. 1 and FIG. 2, according to an exemplary embodiment of the present invention, a continuous variable valve lift (CVVL) apparatus adjusting a valve lift, duration of valve opening and closing, and valve timing includes a cam 101 rotating by a cam shaft 103, a first shaft 105, a second shaft 107, a roller 109, a first arm 111, and a second arm 115.

A radius of the first shaft 105 may be selected according to an exhaust amount of a vehicle engine.

The second shaft 107 has a radius smaller than the radius of the first shaft 105 and is provided in the first shaft 105 such that their centers of rotation do not coincide.

The roller 109 moves upward and downward by a rotation of the cam 101 and is connected to the first shaft 105 to be moved on the basis of a position of the first shaft 105.

The first arm 111 is rotatably connected to the second shaft 107 to be moved by the roller 109.

The second arm 115 is rotatably secured to a third shaft 113 to open and close the valve 117 by an operation of the first arm 111.

The second shaft 107 is secured to a hole formed to the first shaft 105 and the first shaft 105 is coupled to a hole 203 of the arm 201 to which the roller 109 is coupled.

In addition, the above connected body is connected to the first arm 111 and the second shaft 107 is connected to a hole 205 formed in the first arm 111.

That is, a diameter of the first shaft 105 is the same as a diameter of the hole 203 and a diameter of the second shaft 107 is the same as a diameter of a hole formed to the first shaft 105 and a diameter of the hole 205 formed to the first arm 111.

In addition, an elastic member 121 is connected to the second shaft 107 and the second arm 115 is connected to the third shaft 113.

The roller 109 may be a double bearing with an outer bearing 108 contacted to the cam 101 and an inner bearing 110 connected to the first arm 111.

The first arm 111 is tapered such that its far end is thinner than its end at the second shaft 107.

Therefore, if the roller 109 pushes another portion of the first arm 111, the amount of rotation of the first arm 111 changes, changing a timing, as will be described in detail later.

A protrusion 119 is provided on the first arm 111 and the elastic member 121 is connected between the second shaft 107 and the protrusion 119.

That is, if the second shaft 107 rotates counterclockwise, a position of the roller 109 changes.

The elastic member 121 generates a clockwise elastic force to the protrusion 119 and the second shaft 107.

The apparatus may further include a motor 123, such as a step motor, rotating the second shaft 107.

Figure 3:
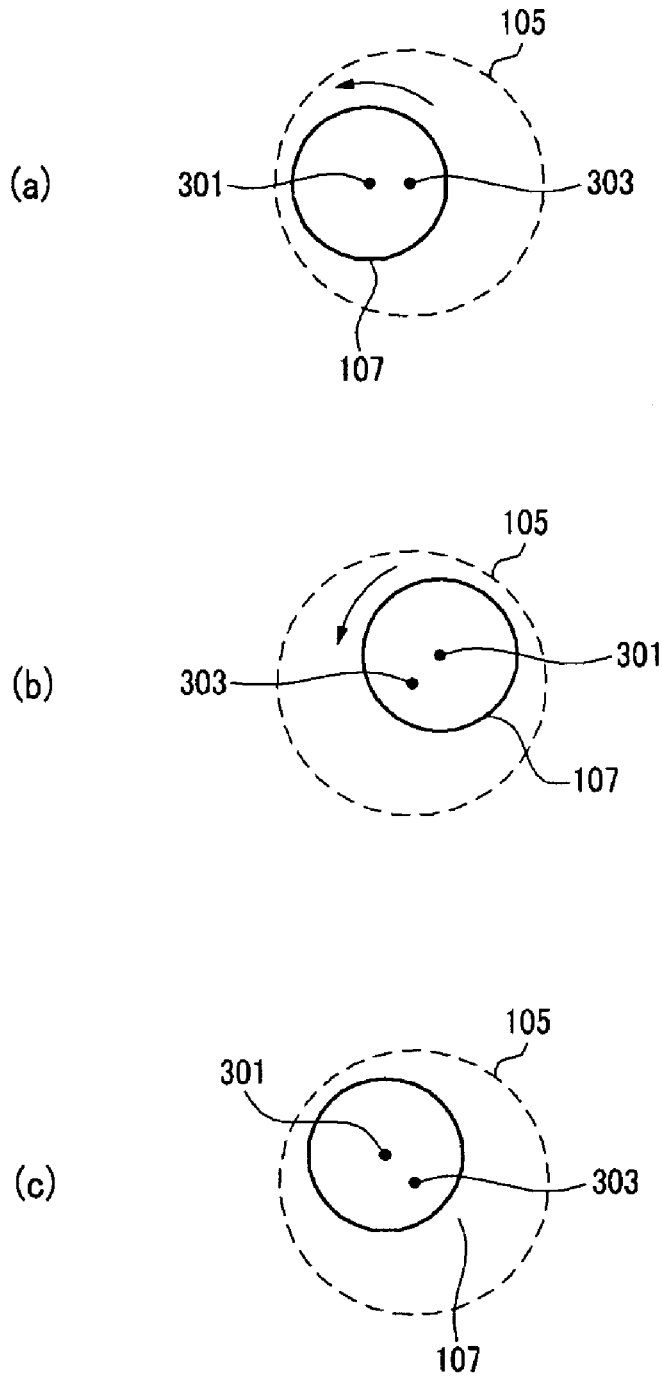
FIG. 3 shows operation of a continuous variable valve lift apparatus according to an exemplary embodiment of the present invention.

Referring to FIG. 3, the second shaft 107 has a smaller radius than the first shaft 105 and if the second shaft 107 rotates, the first shaft 105 rotates.

If the second shaft 107 rotates around a center 301 of the second shaft 107, a center 303 of the first shaft 105 also rotates around the center 301 of the second shaft 107.

Figure 4A:
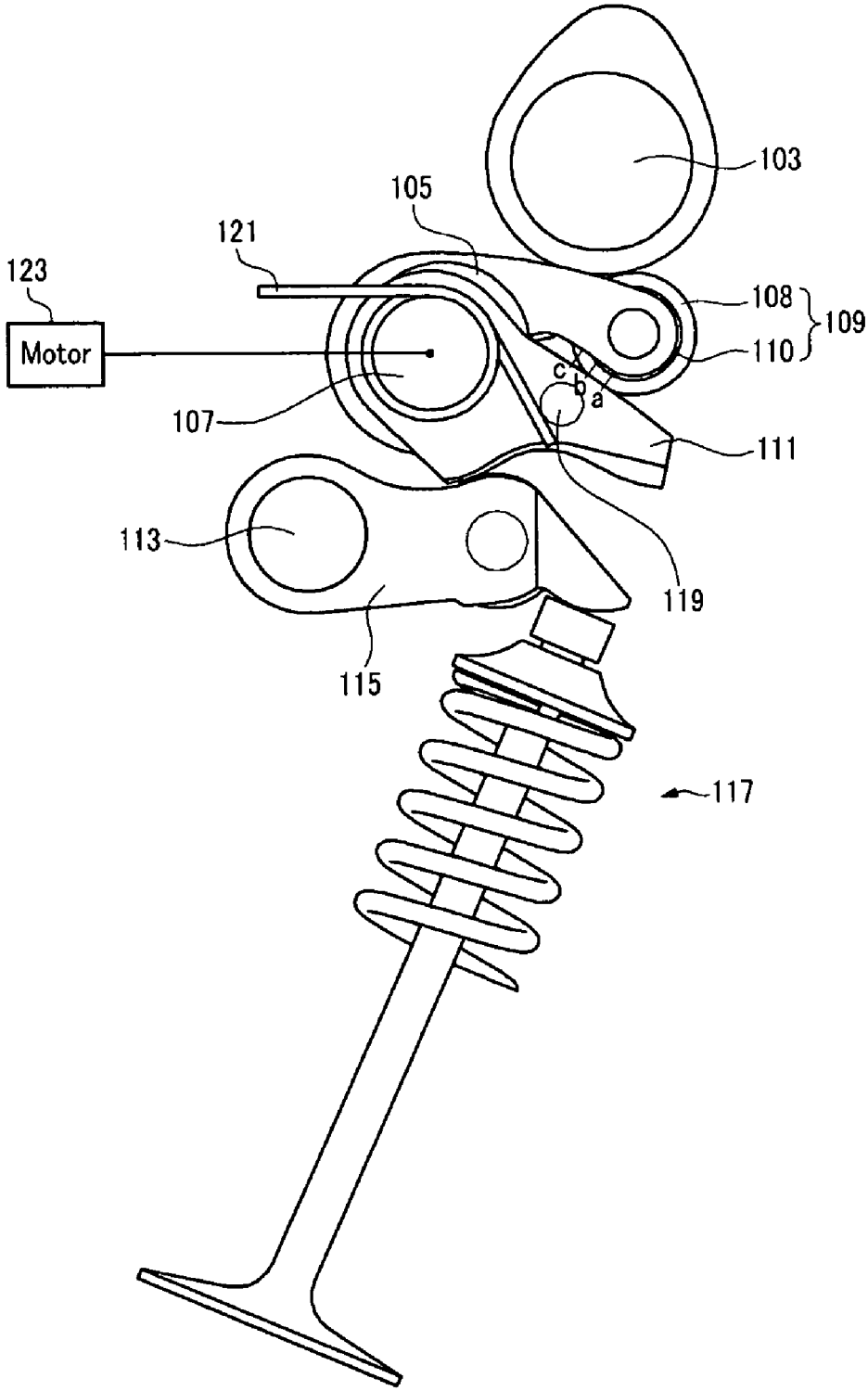
FIG. 4 to FIG. 6 show operation of a continuous variable valve lift apparatus according to an exemplary embodiment of the present invention.
Figure 4B:
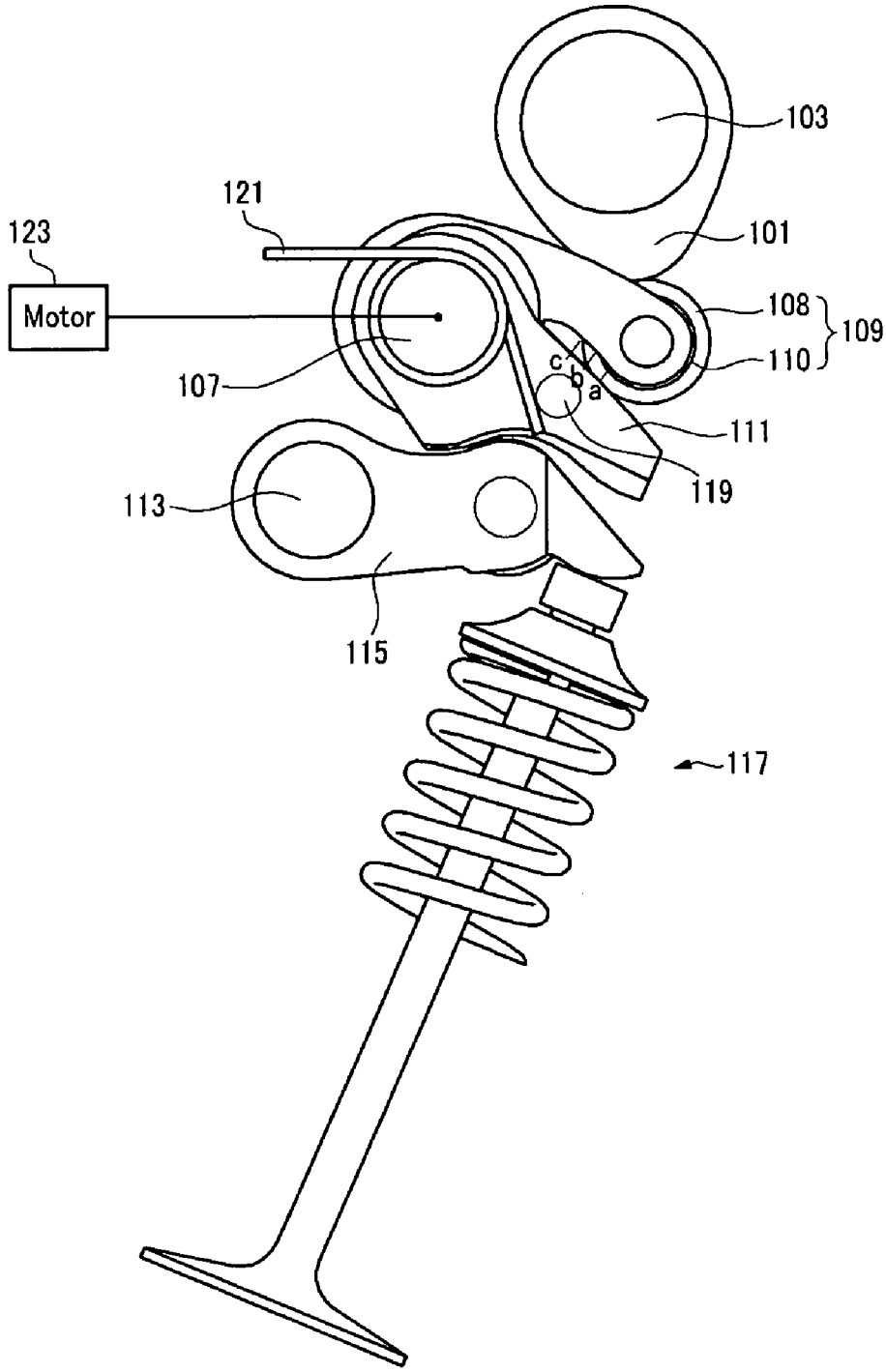
Figure 5A:
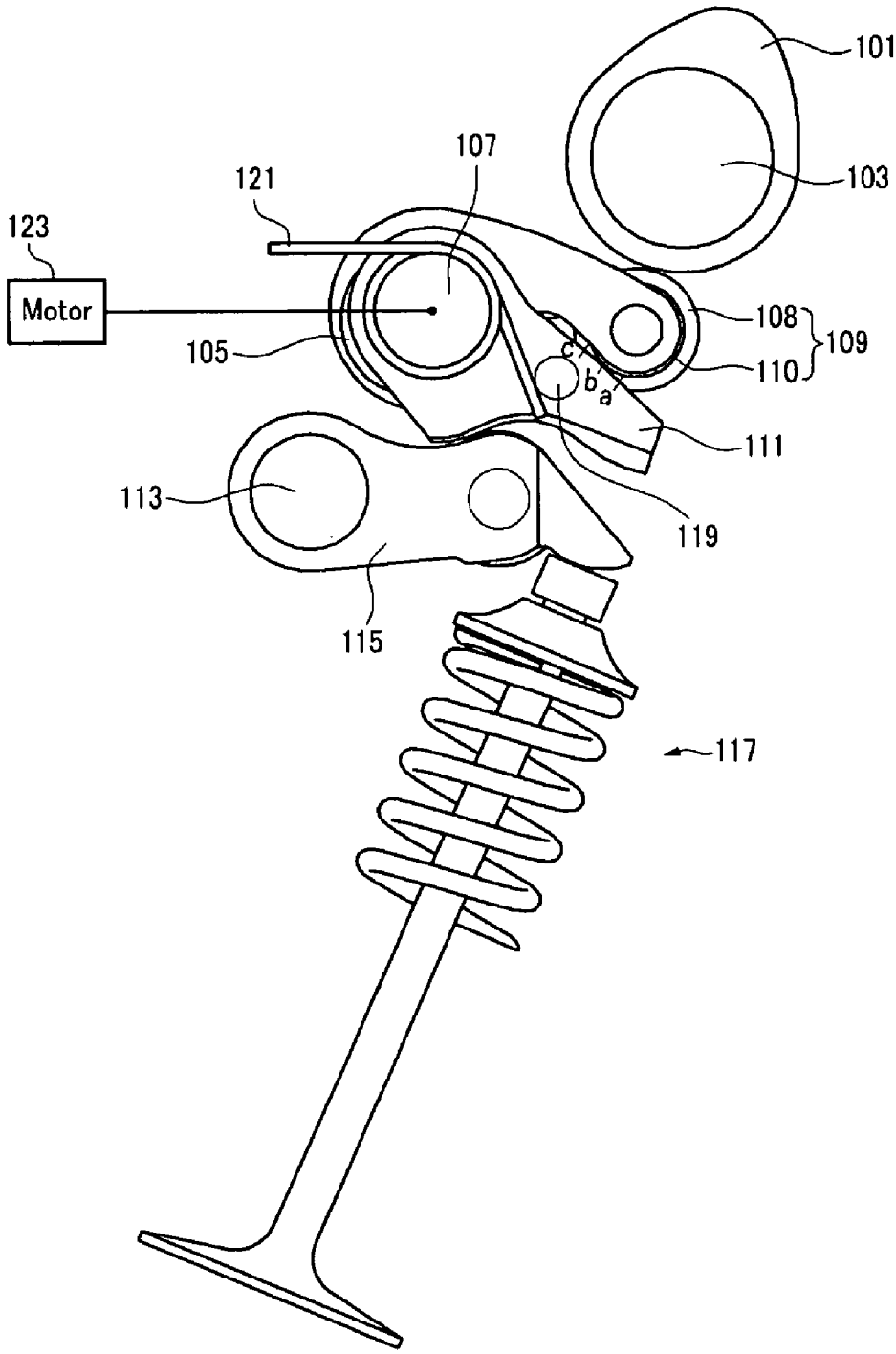
Figure 5B:
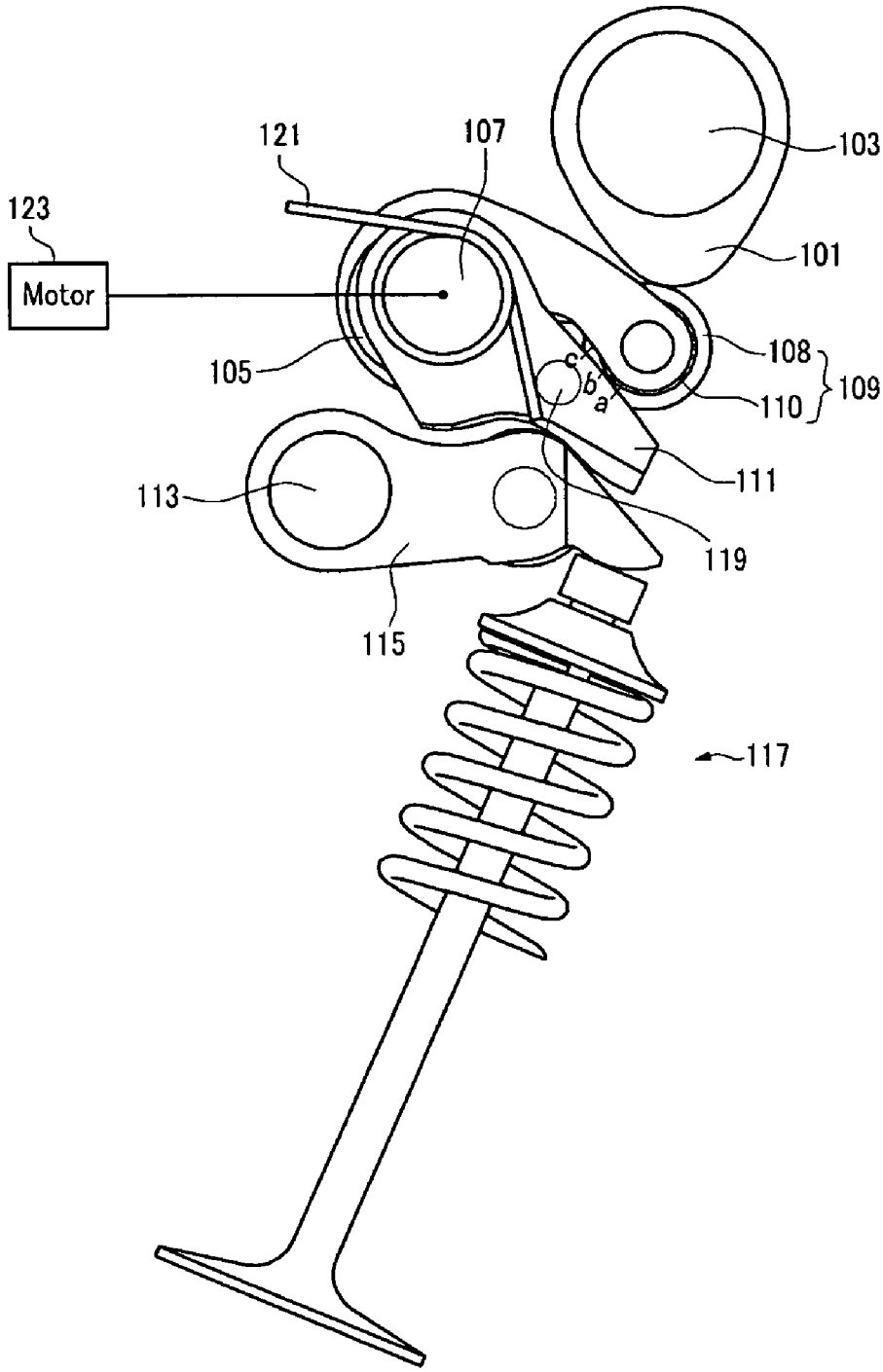
Figure 6A:
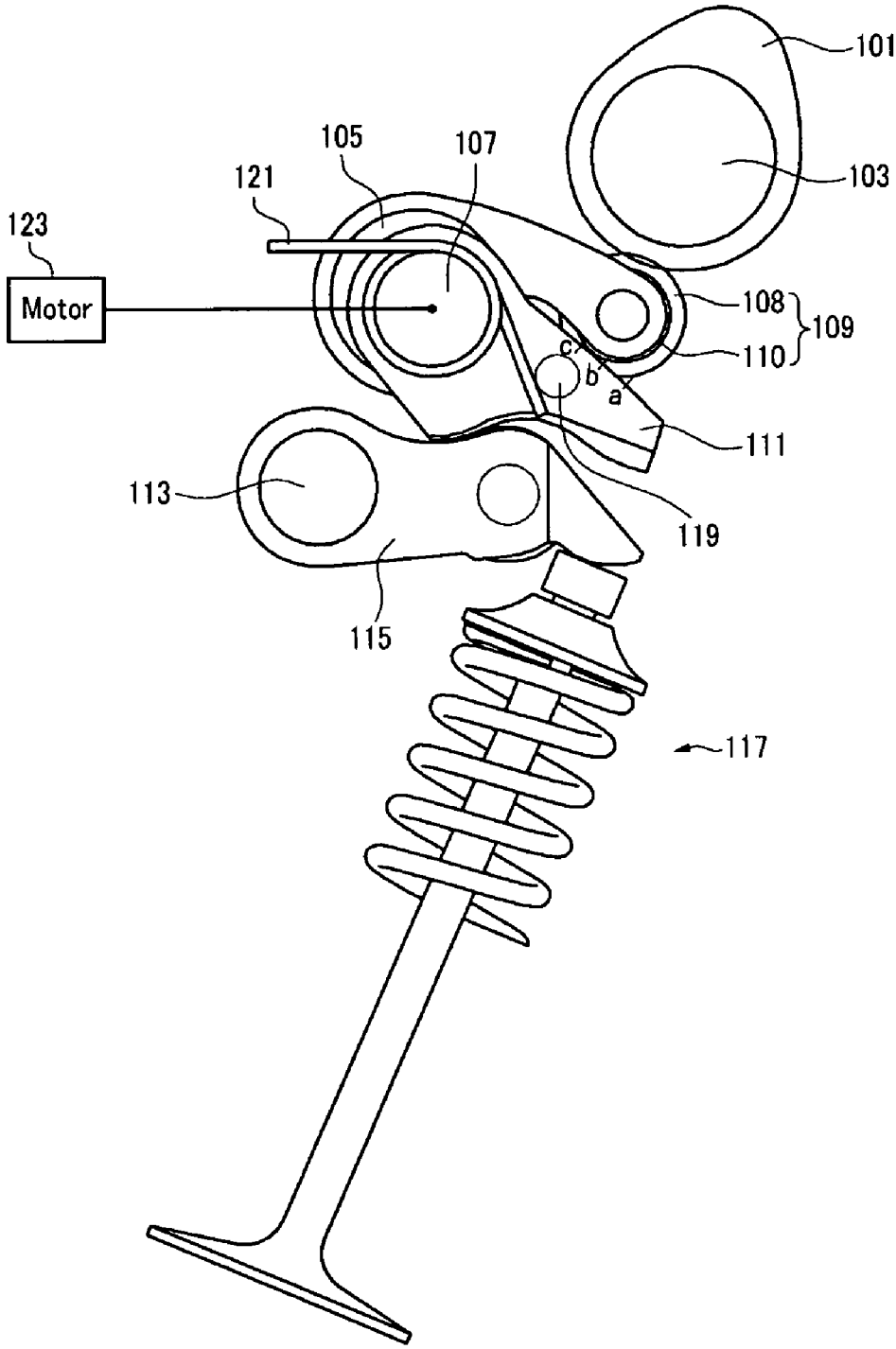
Figure 6B:
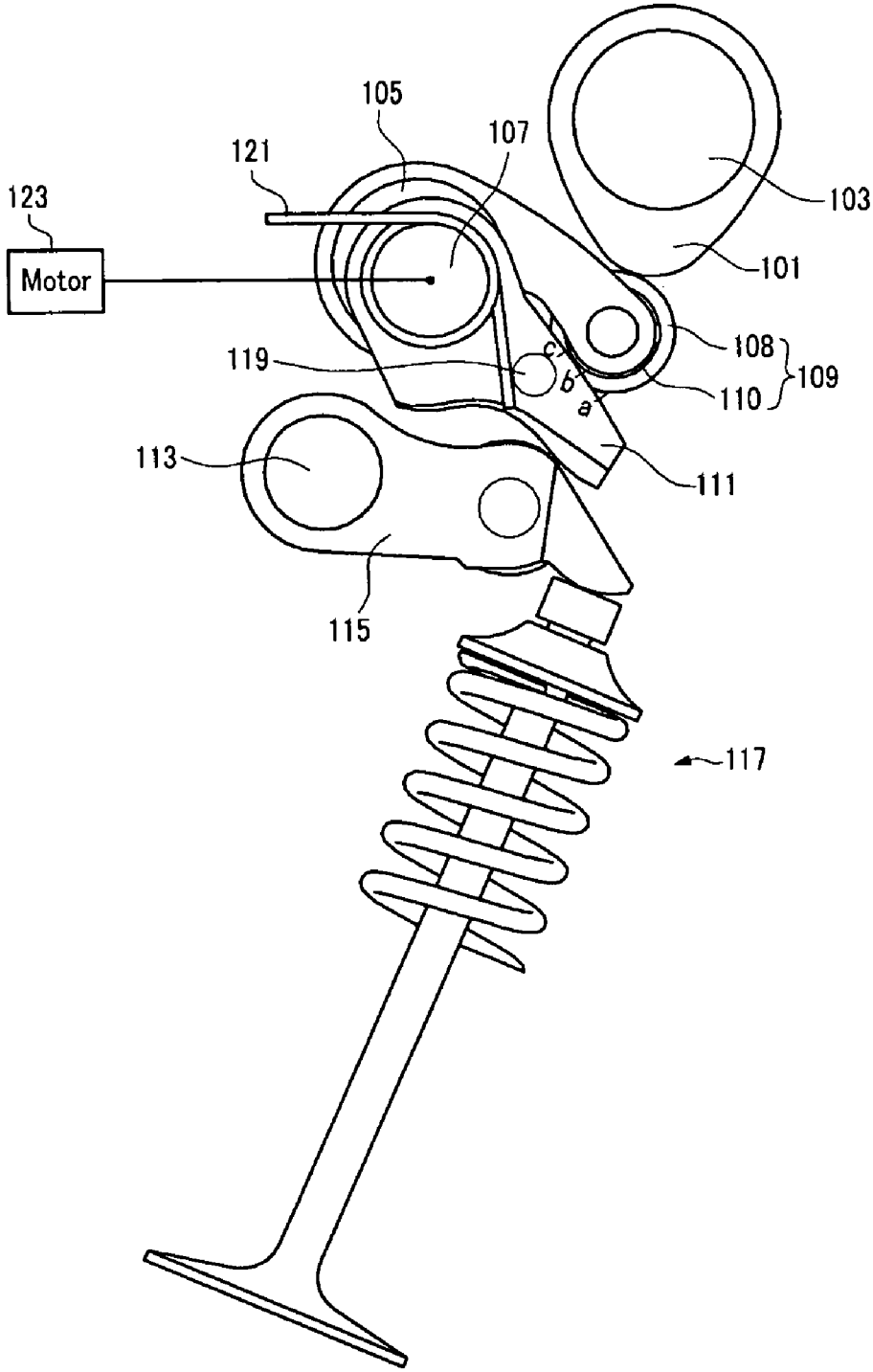

A position of the first shaft shown in FIG. 3 (*a*) is equal to FIG. 4, a position of the first shaft shown in (b) is equal to FIG. 5, and a position of the first shaft shown in (c) is equal to FIG. 6.

That is, if the second shaft 107 is in a position shown if FIG. 4 by rotating, the inner bearing 110 of the roller 109 is located in position 'a' of the first arm 111.

At that time, if the cam 101 rotates and pushes the outer bearing 108, the inner bearing 110 pushes the position 'a'.

Because the first arm 111 is tapered, when the inner bearing 110 pushes the position 'a' by rotation of the cam 101, the amount of rotation of the first arm 111 is smaller than a radius when positions 'b', 'c' are pushed by the inner bearing 110.

Therefore, as shown in FIG. 4 (*b*), the first arm 111 pushes the second arm 115 and the valve 117 is opened and if the cam 101 rotates successively, the valve 117 is closed.

In addition, as shown in FIG. 5 and FIGS. 6 (*a*) and (*b*), if the inner bearing 110 pushes the positions 'b' or 'c' by the rotation of the second shaft 107, the amount of rotation of the first arm 111 is high.

Therefore, lift amount of the valve 117 can be changed by the rotation of the second shaft 107.

In addition, if the inner bearing 110 moves left in the FIGs. and pushes position 'b' or 'c', the duration of the valve opening and closing is changed.

That is, if the inner bearing 110 moves to the position 'b' or 'c', the duration of the valve opening and closing retards and timing of the valve 117 is changed. Further, the rotation angle of the second shaft 107 can be easily controlled by controlling the motor 123.

According to a continuous variable valve lift apparatus of the present invention, the lift, the duration, and the timing of the valve 117 can be simultaneously changed.

According to an exemplary embodiment of the present invention, because of a simple scheme, manufacturing cost is reduced and because the lift, duration, and timing are simultaneously changed, fuel consumption and engine performance are improved.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A continuous variable valve lift (CVVL) apparatus comprising:

a cam rotating by a cam shaft;

a first shaft having a first radius;

a second shaft having a second radius smaller than the first radius and coupled in the first shaft such that the first shaft and the second shaft are non-concentric;

a roller moving upward and downward by a rotation of the cam and connected to the first shaft to be moved on the basis of a position of the first shaft;

a first arm rotatably connected to the second shaft to be moved by the roller; and a second arm rotatably secured to a third shaft to open and close the valve by an operation of the first arm.

2. The apparatus of claim 1, wherein the roller comprises a double bearing.

3. The apparatus of claim 1, wherein the first arm is tapered.

4. The apparatus of claim 1, wherein the first arm comprises a protrusion; the apparatus further comprising an elastic member connected between the second shaft and the protrusion.

5. The apparatus of claim 1, further comprising a motor for rotating the second shaft.

6. The apparatus of claim 5, wherein the motor comprises a step motor.

* * * * *